US008171572B2

(12) United States Patent
Borsa et al.

(10) Patent No.: US 8,171,572 B2
(45) Date of Patent: May 8, 2012

(54) GOGGLE ATTACHMENT SYSTEM FOR HELMET

(75) Inventors: Kimberly Borsa, Montreal (CA); Daniel Packard, Freeport, IL (US)

(73) Assignee: Revision Military Inc., Montreal, QC (CA)

( * ) Notice: Subject to any disclaimer, the term of this patent is extended or adjusted under 35 U.S.C. 154(b) by 747 days.

(21) Appl. No.: 11/973,308

(22) Filed: Oct. 5, 2007

(65) Prior Publication Data

US 2009/0049585 A1 Feb. 26, 2009

Related U.S. Application Data

(60) Provisional application No. 60/850,026, filed on Oct. 6, 2006.

(51) Int. Cl.
*A61F 9/02* (2006.01)

(52) U.S. Cl. ..... 2/452

(58) Field of Classification Search ..... 2/6.3, 410, 2/452; 351/156
See application file for complete search history.

(56) References Cited

U.S. PATENT DOCUMENTS

| | | | | |
|---|---|---|---|---|
| 2,270,238 | A | 1/1942 | Clarke et al. | |
| 5,406,340 | A * | 4/1995 | Hoff | 351/156 |
| 5,469,578 | A | 11/1995 | Mattes | |
| 5,506,730 | A | 4/1996 | Morley et al. | |
| 5,642,178 | A * | 6/1997 | Leonardi et al. | 351/111 |
| 5,802,622 | A * | 9/1998 | Baharad et al. | 2/434 |
| 6,047,410 | A * | 4/2000 | Dondero | 2/426 |
| 6,428,167 | B1 * | 8/2002 | Leonardi | 351/157 |
| 6,449,777 | B1 * | 9/2002 | Montague | 2/452 |
| 6,457,179 | B1 | 10/2002 | Prendergast | |
| 6,472,776 | B1 | 10/2002 | Soto et al. | |
| 6,715,156 | B1 | 4/2004 | Purnell | |
| 6,931,668 | B2 | 8/2005 | Dobbie et al. | |
| 6,992,275 | B1 | 1/2006 | Knapp | |
| 7,581,513 | B2 * | 9/2009 | Di Lullo et al. | 119/850 |
| 2006/0081252 | A1 | 4/2006 | Wood | |

* cited by examiner

*Primary Examiner* — Katherine Moran
(74) *Attorney, Agent, or Firm* — Erickson Law Group, PC

(57) ABSTRACT

A protective goggle assembly includes a protective goggle having two side straps, each side strap comprising a free end and a first surface attachment region adjacent to the free end on at least one surface of each side strap; and a strap assembly that encircles the user's head, on each side of the strap assembly a second surface attachment region is provided that is configured to engage the first surface attachment region of the side straps. The strap assembly includes a base band with opposite free ends and an elastic ring. The free ends of the base band are connected to the elastic ring to form a complete encircling band. The second surface attachment region is carried on two locations of the base band. The complete encircling band is configured to fit around a soldier's helmet and the elastic ring being configured to fit over and around a night vision goggle mount at a front of the helmet.

6 Claims, 10 Drawing Sheets

GOGGLE ATTACHMENT SYSTEM FOR HELMET

This application claims the benefit of U.S. Provisional Application No. 60/850,026, filed Oct. 6, 2006.

TECHNICAL FIELD OF THE INVENTION

The present invention is directed to an attachment system for protective goggles, particularly an attachment system for mounting protective goggles to a protective helmet.

BACKGROUND OF THE INVENTION

For military use, it is known to provide a helmet mount for night vision goggles. Such a helmet mount is described for example in U.S. Pat. Nos. 6,457,179; 6,472,776; 5,506,730 and 6,992,275. U.S. Pat. No. 5,469,578 describes a similar arrangement for a head harness. According to the mounting arrangement of these patents, a single strap extends from a rear of a helmet over a top of the helmet to a top front area of the helmet where the strap connects to a night vision goggle mount. A hook mechanism connects the night vision goggle mount to a front part of the brim of the helmet. The night vision goggle mount can allow for the removal of the night vision goggles assembly or for the flipping down or up of the night vision goggles assembly for use and non use positions, respectively.

For daytime operations, protective goggles are typically worn. It is known to provide protective goggles having an encircling strap to hold the goggles onto a user's face wherein the strap encircles a helmet worn by the user. The strap, however, must encircle the helmet over and around the attachment and adjustment mechanisms of the night vision goggle assembly strap. Putting on and taking off the protective goggles can require the use of both hands, particularly to position the protective goggle strap to clear snags or obstructions between the strap of the protective goggles and hardware of the night vision goggles.

The present inventors have recognized the desirability of providing a protective goggle mounting assembly that allowed protective goggles to be easily switched from a use to a non-use position, preferably by using only one hand.

The present inventors have recognized the desirability of providing a protective goggle mounting assembly that allowed for the protective goggles to be carried in a non-use position on the helmet.

The present inventors have recognized the desirability of providing a protective goggle mounting assembly that was compatible with periodic night vision goggle usage.

The present inventors have recognized the desirability of providing a protective goggle mounting assembly that does not interfere with, ensnare or catch on night vision goggle assembly mounting mechanisms, particularly during putting on or taking off of the protective goggles. The present inventors have recognized the desirability of providing a protective goggle mounting assembly which is compatible to be worn with a night vision goggle assembly and which is easy to put on or take off the user's face.

SUMMARY OF THE INVENTION

The present invention provides a protective goggles mounting system to be used in conjunction with a helmet or a head harness that is easy to install, easy to position between use and nonuse positions, and is cost effectively manufactured.

The present invention provides a protective goggle assembly comprising a protective goggle having side straps, each side strap comprising a free end and an area of surface attachment material adjacent to the free end on at least one surface of the side strap.

A mounting harness is provided having a base band with opposite free ends that are connected to an elastic ring to form a complete encircling band. The elastic ring is configured to fit over and around the night vision goggle mount at a front of the helmet. On each side of the base band a surface attachment region is provided that is configured to engage the surface attachment region of the goggle side straps.

Two securement straps are connected to the base band. Each securement strap is fixed at a base end thereof to the base band and has a free end. The securement straps each include a surface attachment region facing the base band. The goggle side straps include an opposite surface attachment region that faces the surface attachment region of the securement straps. In operation, to position the protective goggles in a non-use position one goggle strap can be disengaged by disengaging first the securement strap and then the goggle strap. The goggle can hang loose supported from the remaining goggle strap to the base band of the mounting band. Alternately, the goggle stap can be disengaged from the base band and hung from the securement strap during non-use of the protective goggles. As the situation warrants, the night vision goggles can be deployed for use over the protective goggles or over the naked eye while the protective goggles are in a non-use position, the protective goggles being supported from the helmet by one goggle strap.

Numerous other advantages and features of the present invention will be become readily apparent from the following detailed description of the invention and the embodiments thereof, and from the accompanying drawings.

DETAILED DESCRIPTION OF THE PREFERRED EMBODIMENTS

Figure 1:
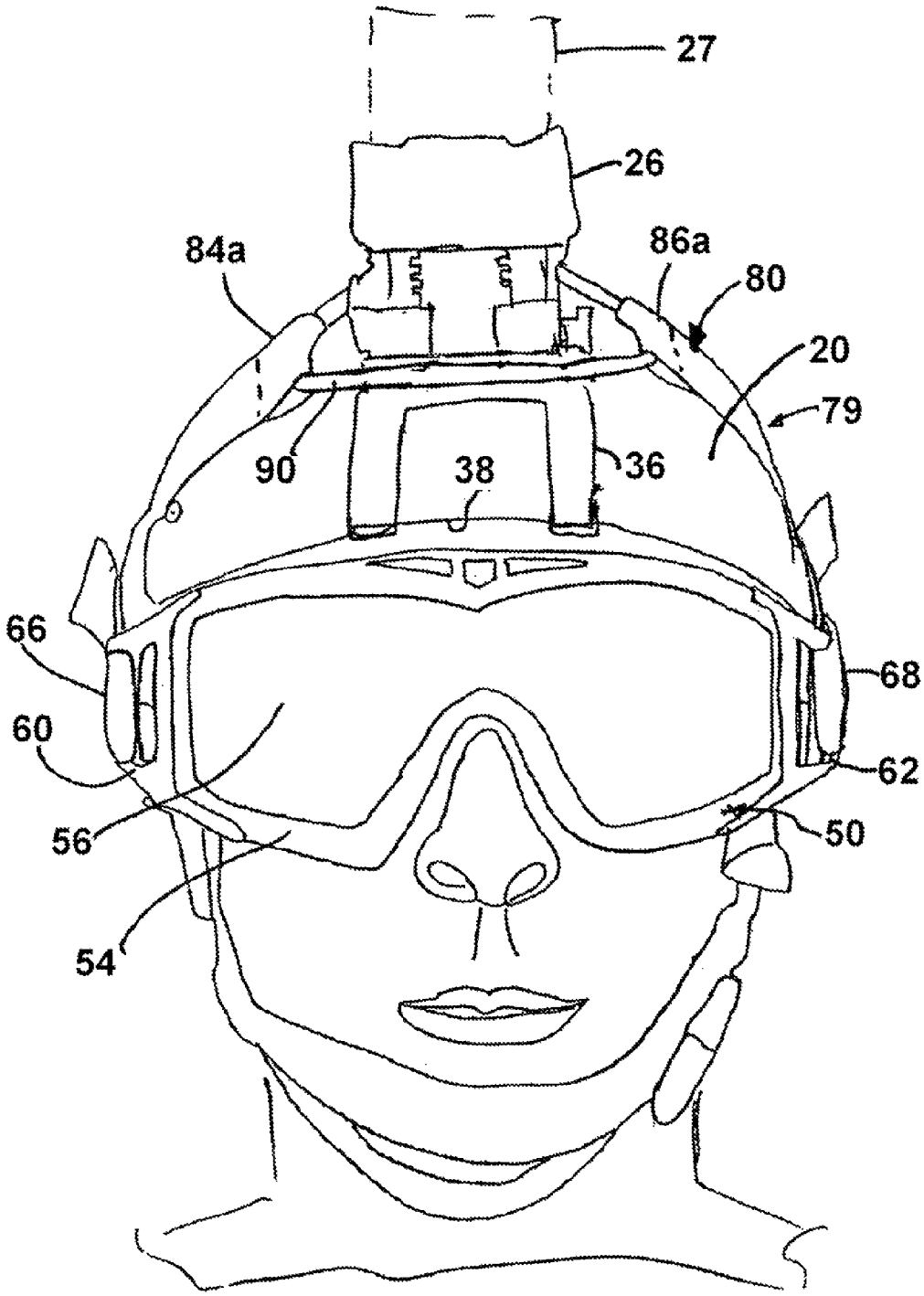
FIG. 1 is a fragmentary front view of a user wearing a protective helmet, the helmet having a flip down mount for night vision goggles and having the protective goggles system according to the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
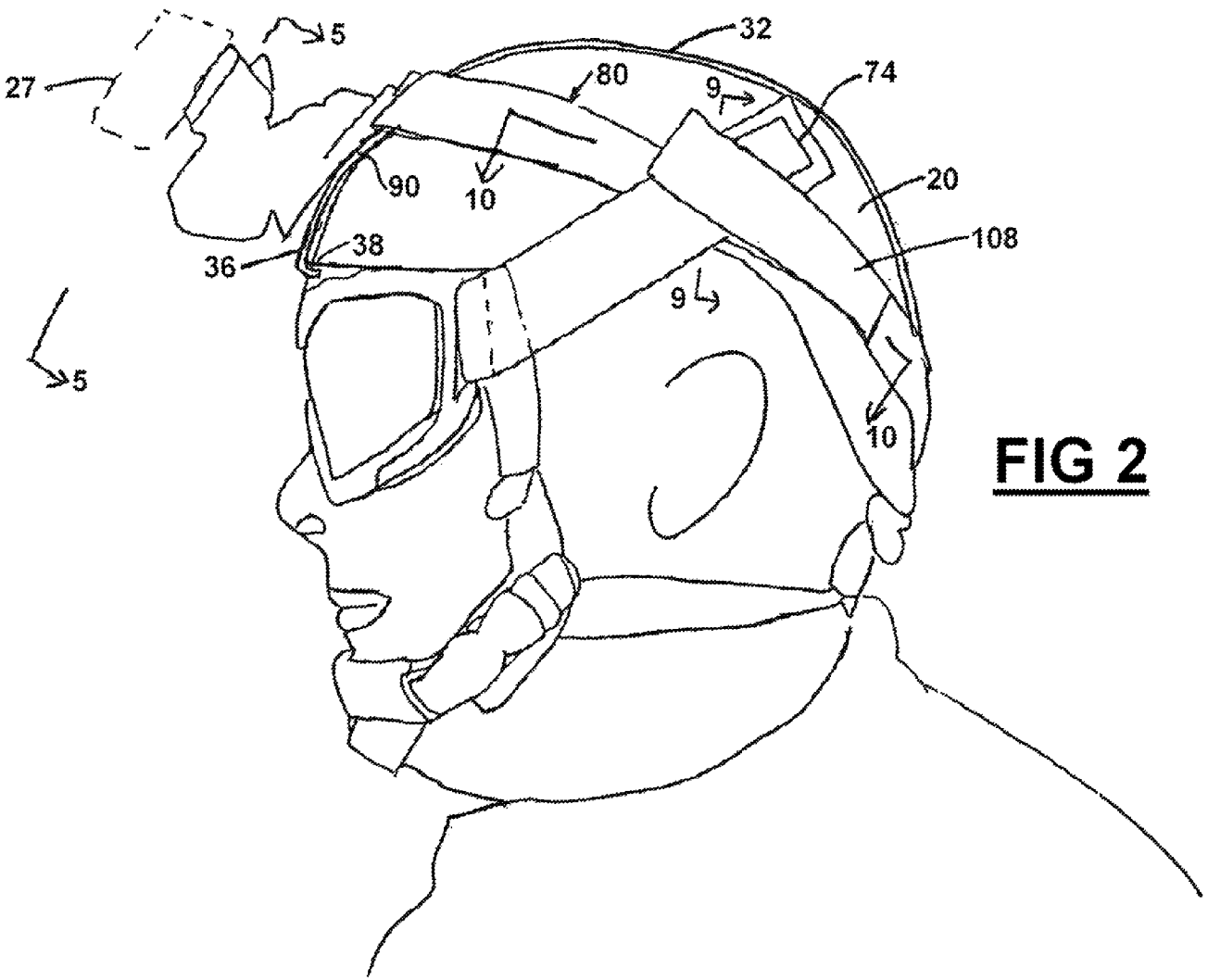
FIG. 2 is a fragmentary right side view of Figure showing the night vision goggles schematically in a non-use position above the protective goggles 1.
Figure 2A:
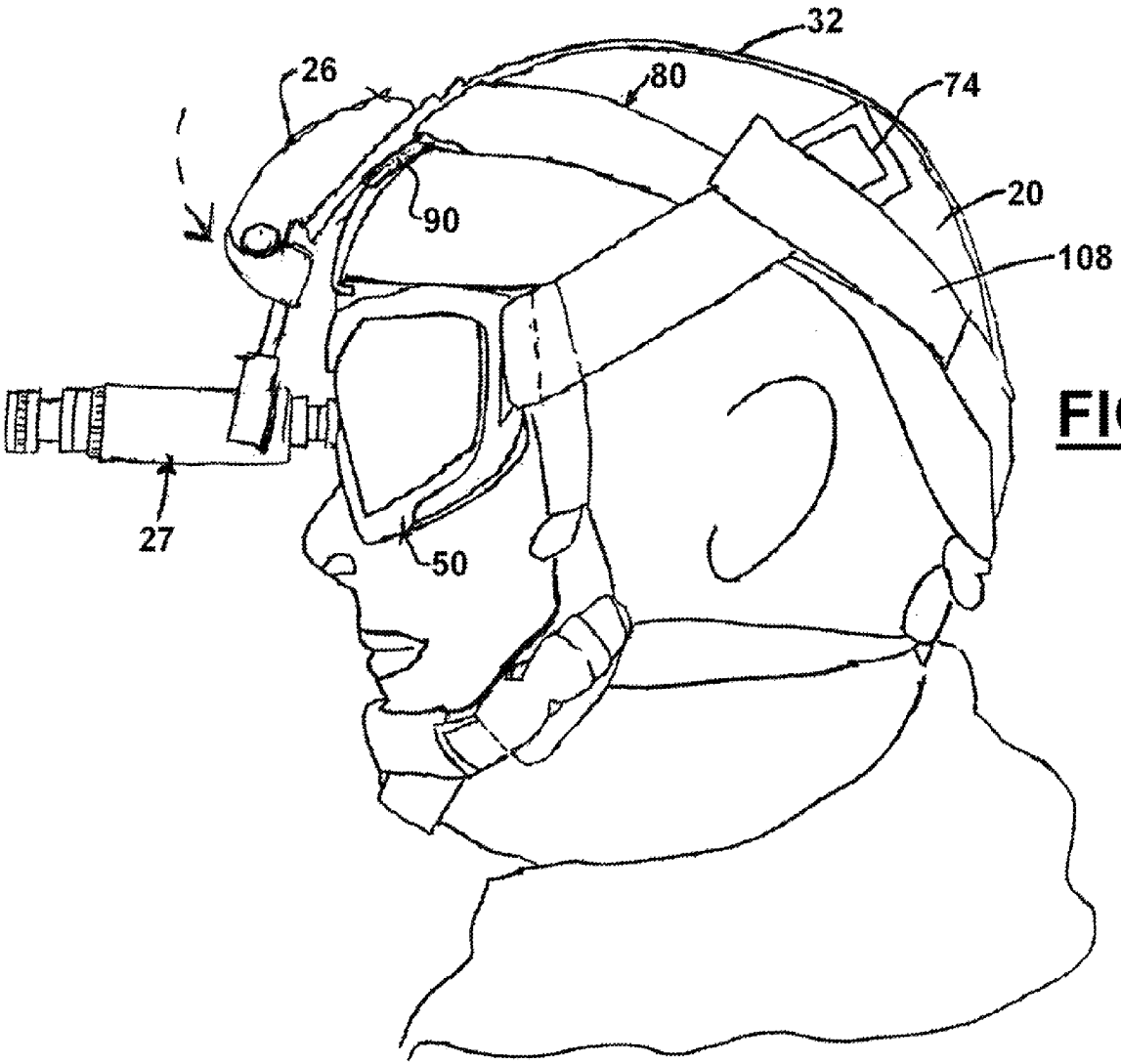
FIG. 2A is a fragmentary right side view showing the night vision goggles in a use position over the protective goggles.

FIGS. 1-2A illustrate a military helmet 20 having a conventional flip down mount 26 for night vision goggles 27 (shown schematically). Such a night vision goggle arrangement is disclosed for example in U.S. Pat. Nos. 6,457,179; 6,472,776; 5,506,730, 5,469,578 and 6,992,275 all herein incorporated by reference.

The mount 26 is carried on the helmet 20 by a strap 32 (FIG. 2) that is adjustably connected at a rear of the helmet, and a hook bracket 36 that engages a brim 38 of the helmet 20.

In FIGS. 1 and 2 the mount 26 is shown in a flipped up, with the night vision goggles in a non-use orientation. In FIG. 2A the mount 26 is shown in a flipped down, night vision goggle in use orientation.

In FIGS. 1-2A protective goggles 50 are shown worn by the user. The protective goggles 50 can be as described in U.S. Ser. No. 11/435,546 filed May 17, 2006, herein incorporated by reference, or can be DESERT LOCUST™ goggles available from Revision Military of Montreal, Canada, or Revision Eyewear, Ltd. of Williston, Vt., USA.

Figure 6:
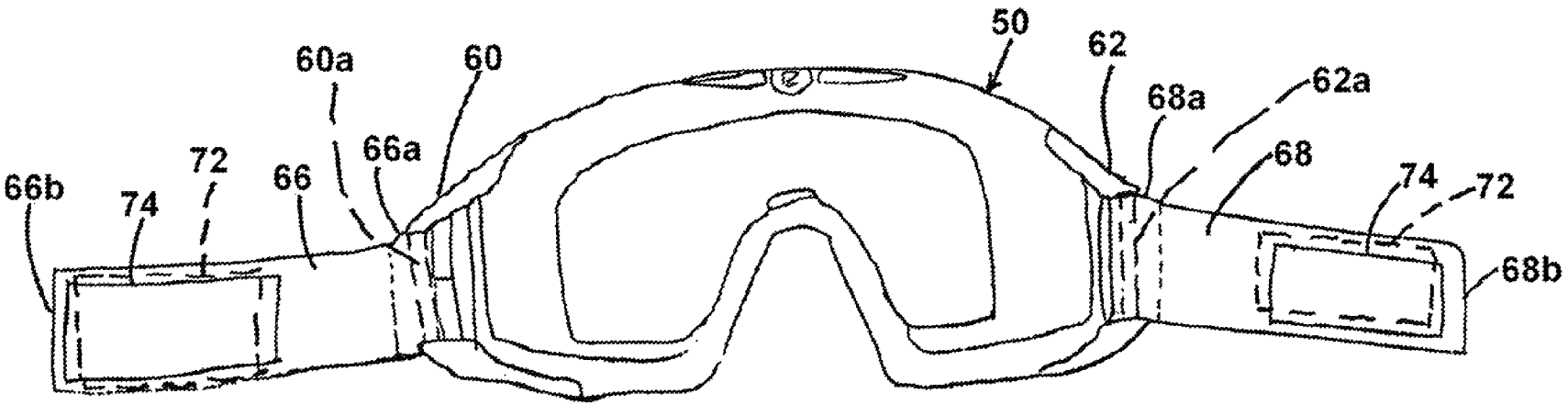
FIG. 6 is a front view of protective goggles in accordance with the invention.

The goggles 50 include a frame 54 that mounts a protective lens 56. On each side of the frame, a strap clip 60, 62 mounts an elastic fabric strap 66, 68. The straps 66, 68 include a sewn loop 66*a*, 68*a* that encircles a bar 60*a*, 62*a* of the clips 60, 62 for attachment thereto (FIG. 6). The straps 66, 68 can be composed of a woven, polyester or cotton yarn wherein the straps are elasticized by a fire-resistant rubber.

The straps 66, 68 each have a free end 66*b*, 68*b*. A first rectangular region of surface attachment material 72 is applied to the straps adjacent to each free end 66*b*, 68*b* applied to the strap face that faces toward the helmet, and a second rectangular region of surface attachment material 74 is applied to the straps adjacent to each free end 66*b*, 68*b* to the strap face that faces away from the helmet 20 (FIG. 6).

The goggles 50 are mounted to the helmet using a protective goggle mounting harness 79. The protective goggles 50 and the harness 79 are constructed symmetrically across a vertical center plane thereof that is centered between the user's eyes. Thus, a description of one side is sufficient to describe both sides.

Figure 3:
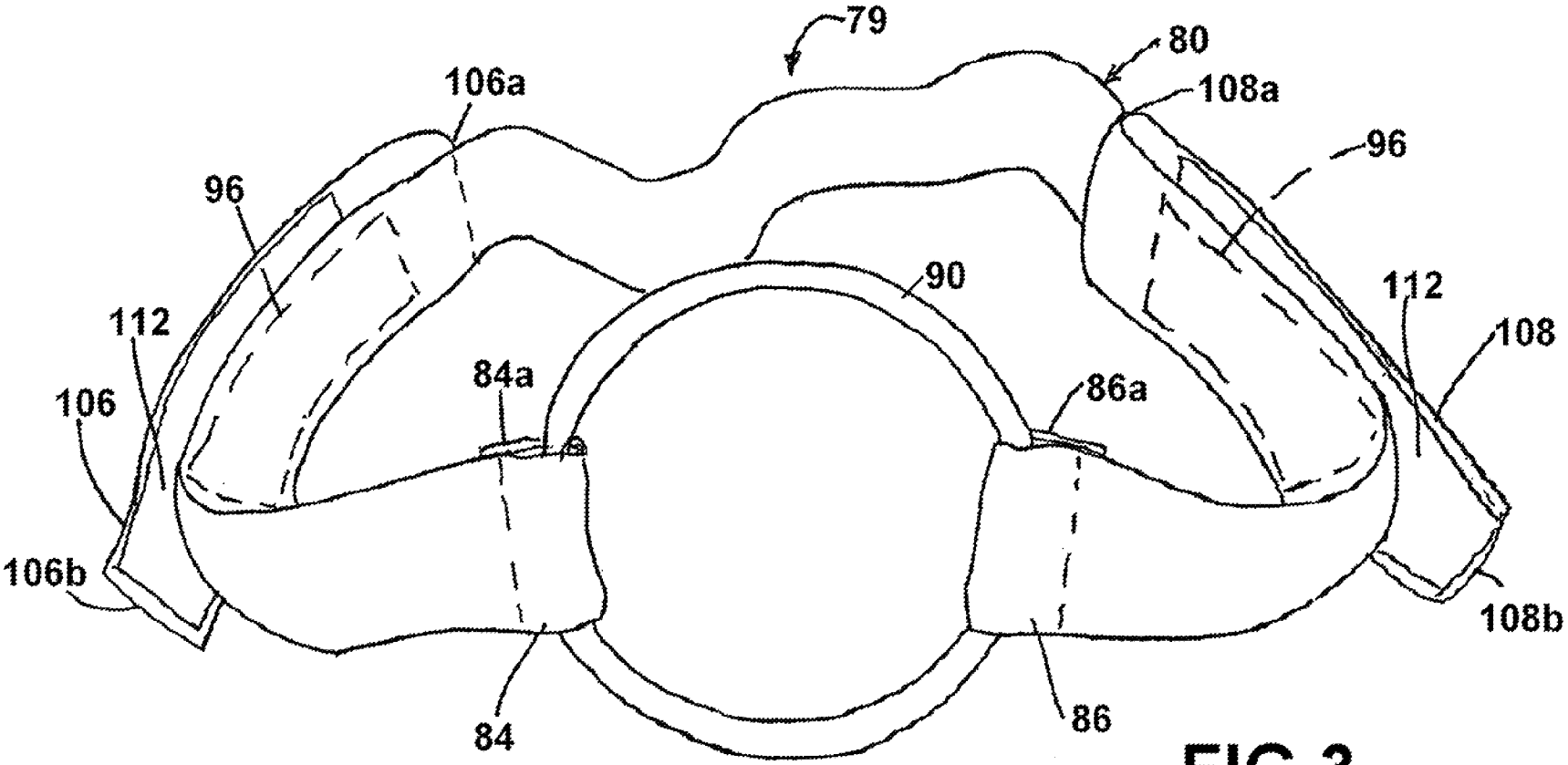
FIG. 3 is a perspective view of a portion of the protective goggles system according to the invention.

The protective goggle mounting harness 79 (FIG. 3) includes a base band 80 that has free ends 84, 86 that are sewn into loops 84*a*, 86*a* at each free end to capture a circular elastic ring 90. The ring 90 has a substantially circular cross-section. The ring can be composed of ethylene-propylene.

On an outside facing surface of the base band 80 are rectangular surface attachment regions 96 located on the band 80 to be on opposite sides of the helmet. Adjacent to the regions 96 are securement straps 106, 108. The securement straps 106, 108 are sewn at base ends 106*a*, 108*a* to the base band 80 behind the regions 96 and have lengths to free ends 106*b*, 108*b* thereof to extend forwardly over the regions 96. Each securement strap 106, 108 includes a securement surface fastener region 112 facing toward the helmet.

The base band and securement straps can be composed of a woven, polyester or cotton yarn wherein the base band and securement straps are elasticized by a fire-resistant rubber.

Figure 9:
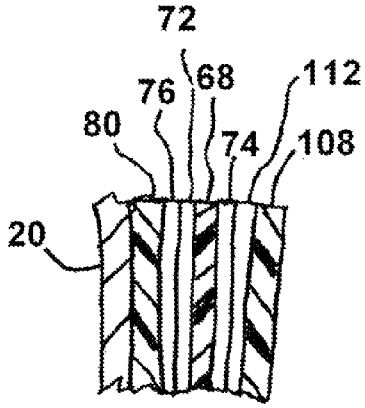
FIG. 9 is a sectional view taken generally along line 9-9 of FIG. 2.

Preferably, the surface fastener regions 74, 96 comprise organized patterns of loops or disorganized or tangled fabric loops, and the surface fastener regions 72, 112 comprise hooks that are configured to engage the loops or tangled fabric looks. Reversing the hooks and loops or providing mixed hooks and loops on mutually engageable surfaces or providing mutually engageable surfaces having only engageable hooks or mushrooms, or other known configurations of hook and loop type fasteners are encompassed by the invention. FIG. 9 illustrates the layers of the attachment system, wherein thicknesses are exaggerated.

Figure 4:
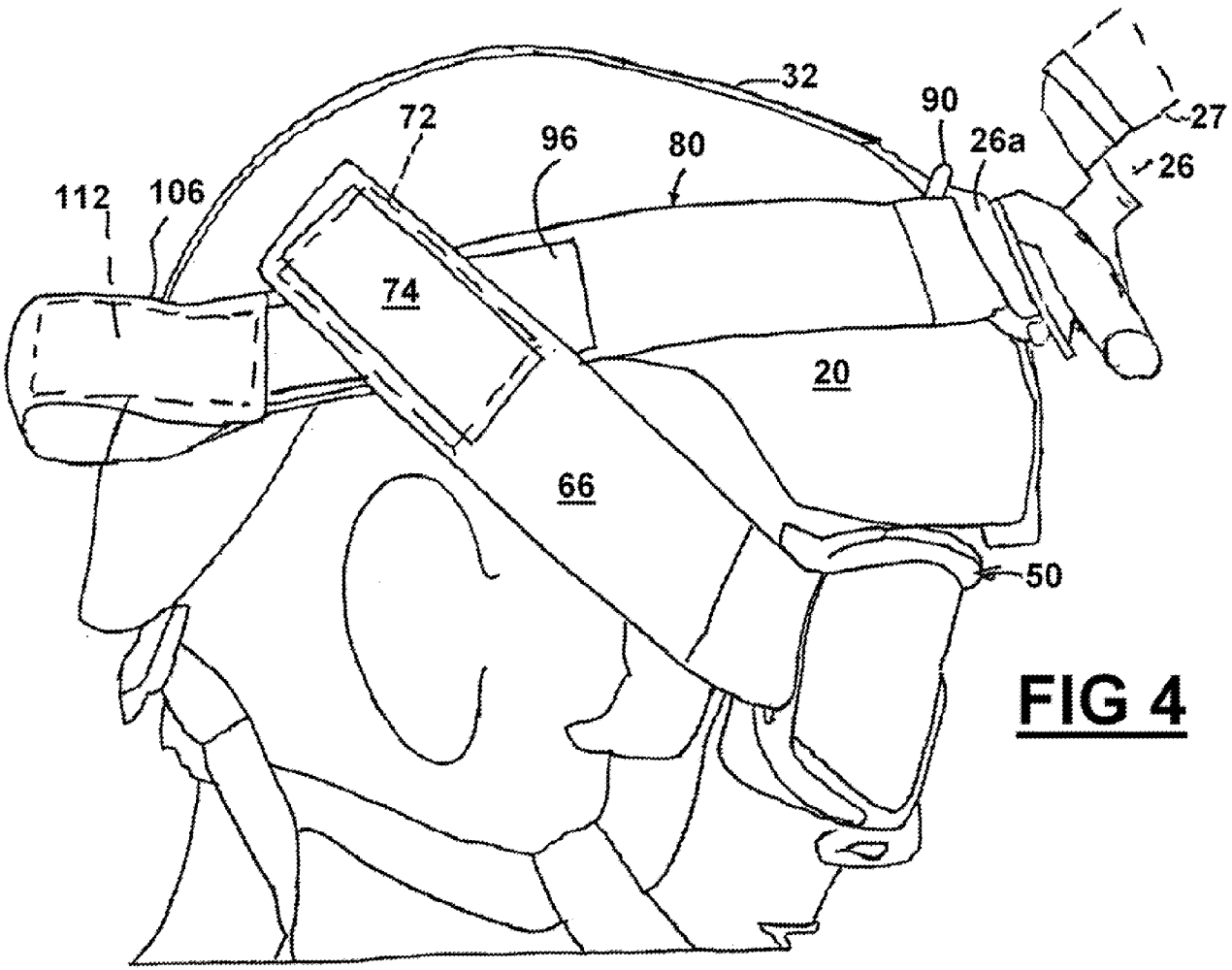
FIG. 4 is a fragmentary left side view of FIG. 1 showing the protective goggles in a stage of removal.
Figure 5:
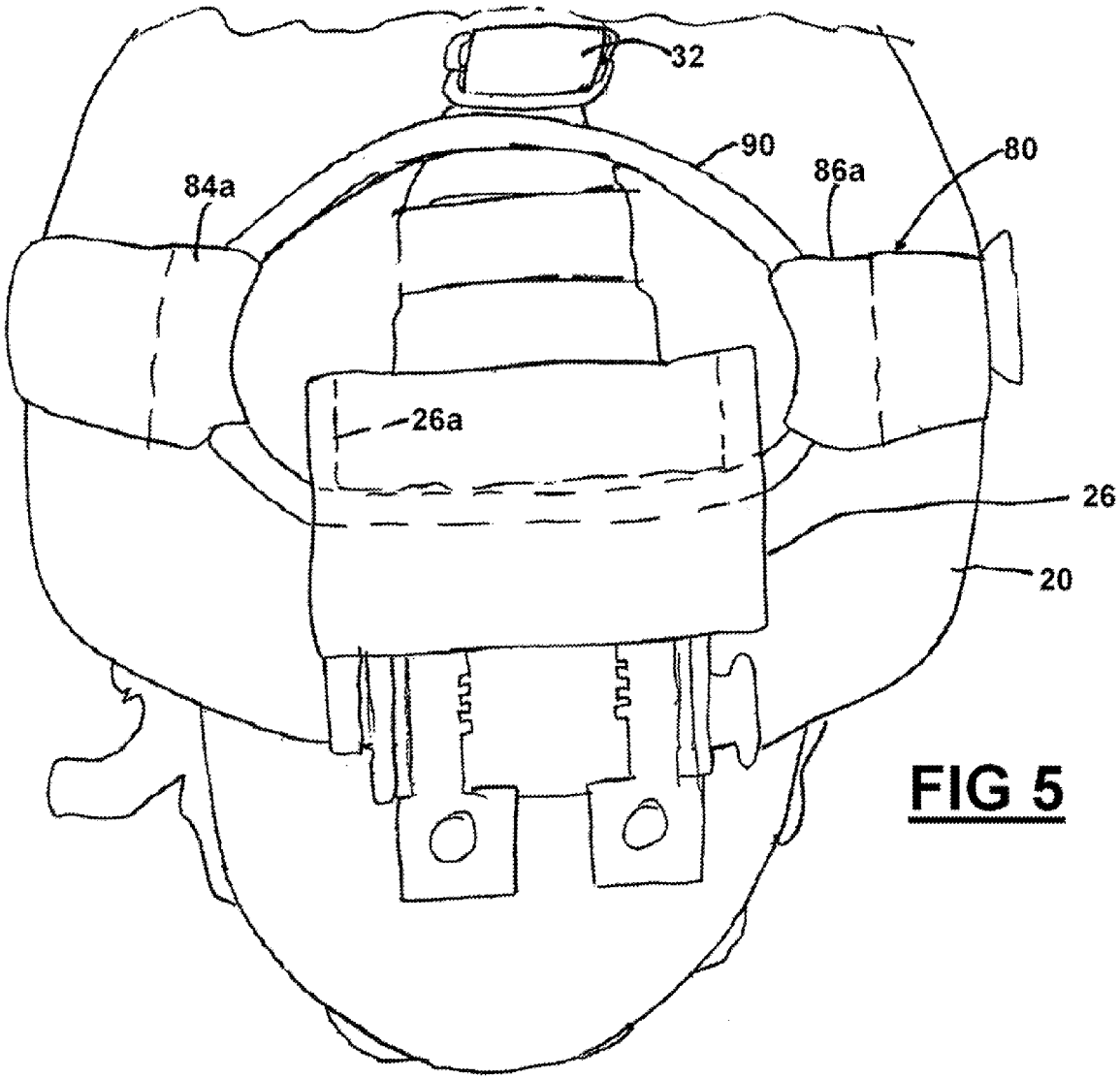
FIG. 5 is a fragmentary view taken generally along line 5-5 of FIG. 2.

FIG. 4 illustrates the securement strap 106 pulled away from the goggle strap 66 as a first step in removing one side of the goggles from the harness 79. The securement strap 106 is looped backward and re-engaged to the surface region 96. The elastic band 90 surrounds a base portion 26*a* of the mount 26 (FIGS. 4 and 5). The elastic band 90 provides sufficient elasticity to be stretched over the mount 26 as needed.

Figure 7:
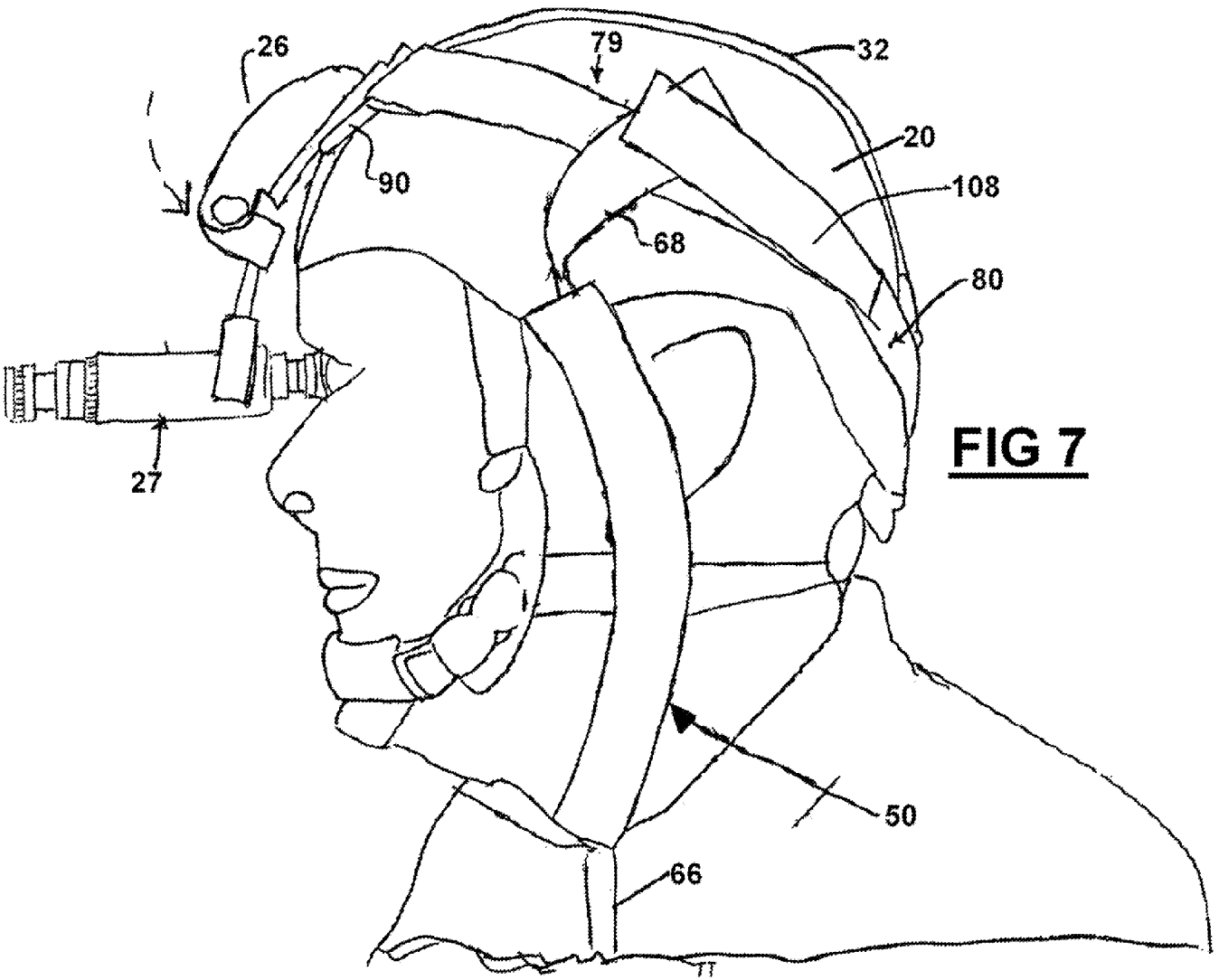
FIG. 7 is a fragmentary right side view according of FIG. 1 showing the protective goggles in a non-use orientation while the night vision goggles are being used.

FIG. 7 illustrates the helmet 20 with the protective goggles 50 disengaged and the night vision goggles mount 26 flipped down for use. The night vision goggles 27 could be used with or without the protective goggles 50 as the situation warrants. The protective goggles 50 are shown somewhat schematically. The protective goggles 50 have been disengaged from the left side of the helmet 20 by disengagement of the securement strap 106 and the goggle strap 66 from the base band 80. As to be seen in FIG. 7, the goggle strap 68 twists slightly under force of gravity and the goggles 50 hang vertically in a non-use position.

Figure 8:
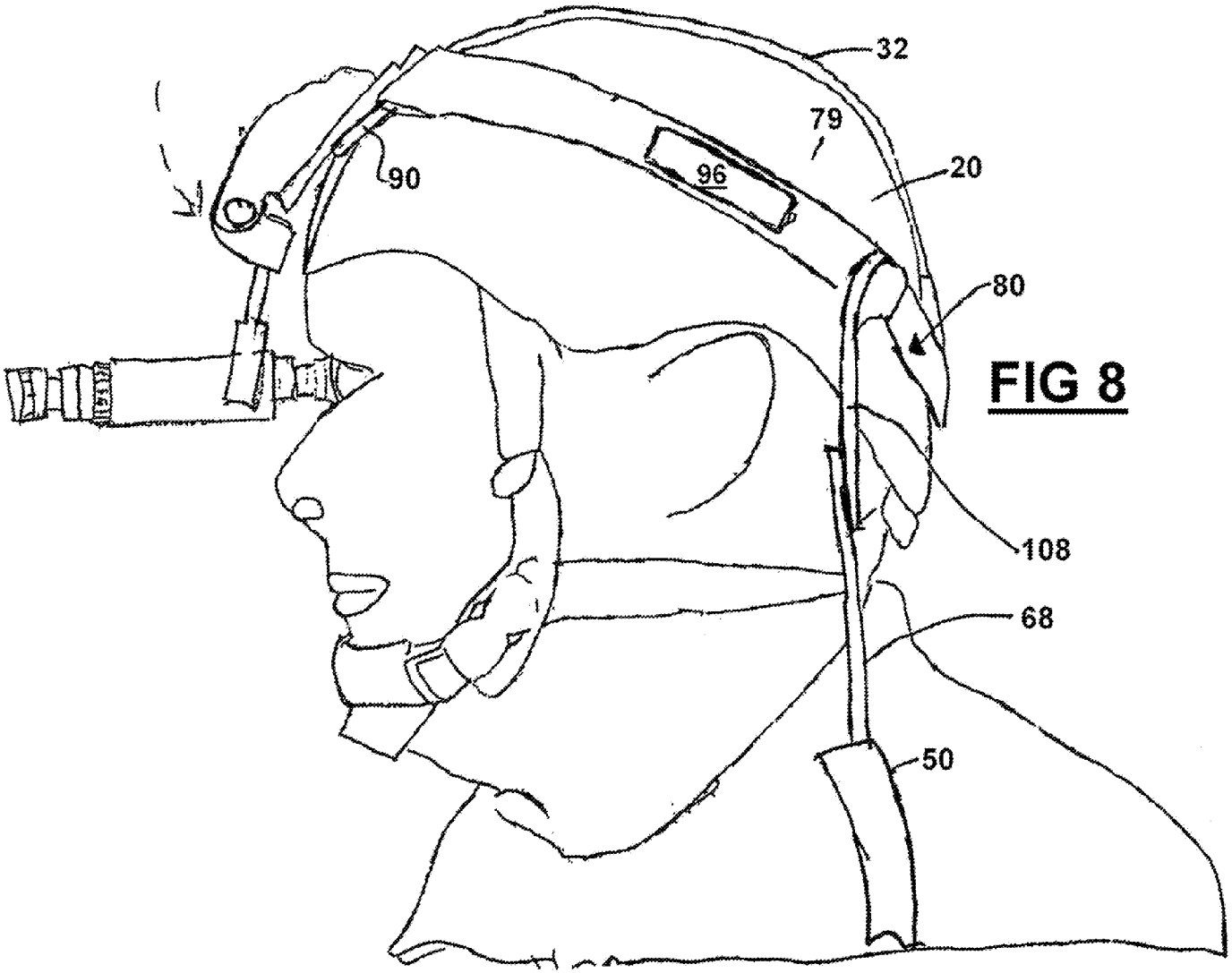
FIG. 8 is a fragmentary right side view according of FIG. 1 showing the protective goggles in an alternate non-use orientation while the night vision goggles are being used.

FIG. 8 illustrates the helmet 20 with the protective goggles 50 disengaged and the night vision goggles mount 26 flipped down for night vision goggle use. The protective goggles are shown somewhat schematically. The protective goggles 50 have been disengaged from the left side of the helmet 20 by disengagement of the securement strap 106 and the goggle strap 66 from the base band 80. The goggle strap 68 has been disengaged from the base band 80 surface region 96, but is retained to the securement strap 108. As to be seen in FIG. 8, the securement strap 108 twists slightly under force of gravity and the goggles 50 hang vertically in a non-use position to a lower elevation compared to FIG. 7.

A lower or higher position of the protective goggles in the non-use position may be desired by the individual user based on other equipment carried by the user or personal preference.

In this regard, the pull-free strength of the surface fastener connections, either the connection between the goggle strap and the securement strap or the connection between the goggle strap and the base band, can be pre-selected to have a built in preference for either the non-use configuration of FIG. 7 or the non-use configuration of FIG. 8 when the securement strap is pulled by the user.

Figure 10:
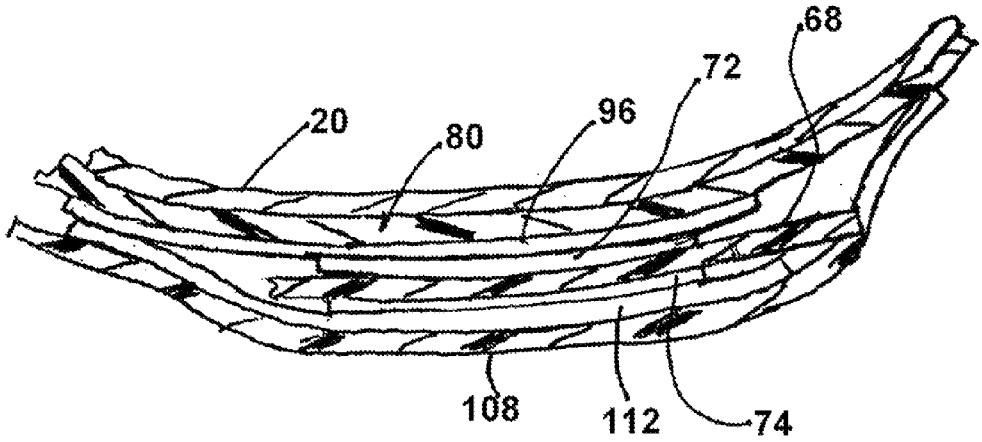
FIG. 10 is a sectional view taken generally along line 9-9 of FIG. 2 showing an alternate embodiment arrangement.

FIG. 10 illustrates an alternate embodiment wherein the securement straps 106, 108 and the regions 112 of each securement strap have sufficient lengths to expand over the region 74 in order for the region 112 to engage the region 74 and to also extend over the region 96 to also engage the region 96. This configuration could provide some additional security for holding goggles to the helmet.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A protective goggle assembly comprising:

a protective goggle having two side straps, each side strap comprising a free end and a first surface attachment region adjacent to the free end on at least one surface of each side strap; and a strap assembly that encircles the user's head, on each side of the strap assembly a second surface attachment region is provided that is configured to engage the first surface attachment region of the side straps, wherein said strap assembly comprises a base band with opposite free ends and an elastic ring, said free ends of said base band connected to said elastic ring to form a complete encircling band, said second surface attachment region carried on two locations of said base band, said complete encircling band configured to fit around a soldier's helmet and said elastic ring being configured to fit over and around a night vision goggle mcount at a front of said helmet, wherein said strap assembly further comprises two securement straps connected to said base band, each securement strap is fixed at a base end thereof to the base band and has a free end, said securement straps each include a third surface attachment region facing said base band, and said goggle side straps include an opposite, fourth surface attachment region that faces the third surface attachment region of the securement straps said third and fourth surface attachment regions being mutually engagable.

2. A protective goggle assembly comprising:

a protective goggle having at least one side strap, said side strap comprising a free end and a first surface attachment region adjacent to the free end on at least one surface of said side strap; and a strap assembly that encircles the user's head, said strap assembly having a second surface attachment region that is configured to engage the first surface attachment region of said side strap, wherein said strap assembly comprises a base band with opposite free ends and an elastic ring, said free ends of said base band connected to said elastic ring to form a complete encircling band, said second surface attachment region carried on said base band, said complete encircling band configured to fit around a soldier's helmet and said elastic ring being configured to fit over and around a night vision goggle mount at a front of said helmet, wherein said strap assembly further comprises a securement strap connected to said base band, said securement strap being fixed at a base end thereof to the base band and has a free end, said securement strap including a third surface attachment region facing said base band, and said goggle side strap includes an opposite, fourth surface attachment region that faces the third surface attachment region of the securement strap and said third and fourth surface attachment regions being mutually engagable.

3. The protective goggle assembly according to claim 2, wherein said protective goggle comprises a frame supporting a lens and said at least one side strap comprises two &de straps, one side strap extending from each side of said frame, and said first attachment comprises a first surface fastener region carried on each of said side straps facing said base band, and said second attachment comprises a second surface fastener region on each side of said base band and arranged to mutually engage a respective one of said first surface fastener regions of said side straps to snugly mount said protective goggle on the face of a user.

4. A protective goggle assembly for a helmet, comprising:

a protective goggle having at least one side strap, said side strap comprising a free end and a first attachment adjacent to said free end; and a strap assembly that encircles the helmet, said strap assembly having a second attachment that is configured to engage the first attachment of said side strap, wherein said strap assembly comprises a base band with opposite free ends and an elastic ring, said free ends of said base band connected to said elastic ring to form a complete encircling band, said second attachment carried on said base band, said complete encircling band configured to resiliently fit around a soldier's helmet, wherein said strap assembly further comprises a securement strap connected to said base band, said securement strap being fixed at a base end thereof to the base band and has a free end, said securement strap including a third attachment facing said base band, and said goggle side strap includes an opposite, fourth attachment that faces the third attachment of the securement strap and said third and fourth attachments being mutually engagable.

5. The protective goggle assembly according to claim 4, wherein said first, second third and fourth attachments comprise hook and loop fastening tapes.

6. The protective goggle assembly according to claim 4, wherein said protective goggle comprises a frame supporting a lens and said at least one side strap comprises two side straps, one side strap extending from each side of said frame, and said first attachment comprises a first surface fastener region carried on each of said side straps facing said base band, and said second attachment comprises a second surface fastener region on each side of said base band and arranged to mutually engage a respective one of said first surface fastener regions of said side straps to snugly mount said protective goggle on the face of a user.

* * * * *